US007074302B2

(12) United States Patent
Renck et al.

(10) Patent No.: US 7,074,302 B2
(45) Date of Patent: Jul. 11, 2006

(54) APPARATUS AND PROCESS FOR FORMING THREE-DIMENSIONAL FIBROUS PANELS

(75) Inventors: Lawrence E. Renck, Hartsville, SC (US); Jimmy W. Cassidy, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 293 days.

(21) Appl. No.: 10/729,686

(22) Filed: Dec. 5, 2003

(65) Prior Publication Data

US 2005/0121163 A1 Jun. 9, 2005

(51) Int. Cl.
*D21J 3/00* (2006.01)

(52) U.S. Cl. ..... 162/227; 162/218; 162/223; 162/224; 162/382; 162/396; 162/397; 241/60; 241/113; 264/87

(58) Field of Classification Search ..... 162/218–230, 162/382–390, 396–406; 206/521.1; 264/86, 264/87; 425/84, 85; 249/60, 113
See application file for complete search history.

(56) References Cited

U.S. PATENT DOCUMENTS 4,702,870 A 10/1987 Setterholm et al.
4,753,713 A 6/1988 Gunderson
5,277,854 A * 1/1994 Hunt ..... 264/86
5,833,805 A 11/1998 Emery
5,876,835 A 3/1999 Noble et al.
5,900,304 A 5/1999 Owens
6,190,151 B1 * 2/2001 Hunt ..... 425/80.1
6,451,235 B1 9/2002 Owens

FOREIGN PATENT DOCUMENTS

EP 0 406 783 A2 1/1991

OTHER PUBLICATIONS

Copy of European Search Report for European Application No. 04257218.0; Filed Nov. 20, 2004; Date of Completion Apr. 22, 2005.

* cited by examiner

*Primary Examiner*—Eric Hug
(74) *Attorney, Agent, or Firm*—Alston & Bird LLP

(57) ABSTRACT

A fibrous panel is molded in two or more progressively formed mold members each comprising a porous support plate to which a plurality of rigid mold pieces are affixed. The mold pieces are truncated 3D tapered structures, and are arranged on the support plate in a regular array so that an intersecting grid or lattice of channels is defined between them. A fiber stock is poured into a first mold member and the stock is compressed and dewatered to form a panel. The panel is removed from the first mold member and placed into a second mold member having narrower and shallower channels whose side walls are more upright than those of the first mold member. The panel is further compressed and dewatered in the second mold member, and is densified in both the vertical and lateral directions by virtue of the progressive formation of the mold members.

18 Claims, 4 Drawing Sheets

APPARATUS AND PROCESS FOR FORMING THREE-DIMENSIONAL FIBROUS PANELS

FIELD OF THE INVENTION

The invention relates to the formation of fibrous panels by introducing an aqueous fiber stock into a mold and dewatering and compressing the stock to form a wet panel that is subsequently removed from the mold and dried.

BACKGROUND OF THE INVENTION

Traditionally, it has been common to use wood such as plywood when there is a need for structural panels of relatively low cost. Increasingly, however, efforts have been made to develop low-cost structural panels from molded fibrous material such as wood fibers of the type used in some papermaking processes. In one process, an aqueous fiber stock is vacuum deposited on a porous mold or screen. The stock is partially dewatered and conforms to the shape of the mold to form a wet molded panel. The panel is removed from the mold and dried in a dryer to remove the water. In many cases, only the side of the panel that was against the mold is finished (i.e., smooth); the opposite side, which was not contacted by any mold surface, remains unfinished or rough.

More recently, processes have been developed wherein the panel is pressed between two mold parts so that both sides of the panel are finished. One such process is disclosed in U.S. Pat. No. 4,702,870 to Setterholm et al. The process produces a three-dimensional panel that is flat on one side and has a system of intersecting ribs similar to a honeycomb structure projecting from the opposite side. To make the panel, an aqueous fiber stock is deposited into a mold comprising a porous support plate or screen on which are affixed a plurality of resilient elastomeric mold pieces or projections of truncated conical or pyramidal shape. The mold pieces are spaced apart on the porous support plate so that intersecting channels are defined between the mold pieces. The aqueous stock fills the mold to a depth greater than the height of the mold pieces, so the stock covers the upper surfaces of the mold pieces. A flat mold plate is urged against the stock and presses the stock down into the mold; the stock is dewatered through openings in the porous support plate. The pressure on the stock in the urging direction causes compression and densification of the panel in its thickness direction (i.e., perpendicular to its plane). Moreover, this pressure also causes the elastomeric mold pieces to be compressed to a smaller height, and as a result they grow in width or diameter and thereby exert pressure on the stock in the lateral direction (i.e., parallel to the plane of the panel). Accordingly, the ribs of the panel that are formed in the channels between the mold pieces are compressed both in the thickness direction and the lateral direction. The process thus is able to produce a panel with substantially homogeneous density in all directions, and with substantial bending stiffness relative to its weight.

A drawback of the process of the '870 patent, however, is that the compressible mold pieces are not very durable and tend to break or become detached from the support plate after a relatively small number of molding cycles. Furthermore, the mold pieces tend to become compression-set so that they lose their ability to provide the needed lateral compression of the panel ribs. The compressible mold pieces thus must be replaced periodically, which is time-consuming and expensive.

SUMMARY OF THE INVENTION

The invention addresses the above needs and achieves other advantages, by providing a process and apparatus for making a three-dimensional fibrous panel wherein two or more progressively formed molds are employed. Each mold has a support plate having water drain openings, and a plurality of rigid mold pieces affixed to the support plate. The mold pieces are of truncated conical or pyramidal shape and are spaced apart on the support plate to define channels between them for forming ribs on a panel. In accordance with the invention, a panel is initially formed in a first mold characterized by mold pieces whose draft angle (i.e., the angle between the side surfaces of the mold piece and the vertical or thickness direction of the panel) is relatively large to facilitate removal of the panel from the first mold; the channels between the mold pieces are relatively wide. After pressing in the first mold, the panel is removed and is placed into a second mold generally similar to the first mold but characterized by mold pieces of smaller draft angle and smaller height, and by narrower channels. The panel is pressed in the second mold to re-form and further compress and densify the panel. The ribs are compressed in the lateral direction because the channels are narrower than the widths of the ribs as formed in the first mold, and are compressed in the thickness or vertical direction because the channels are less deep than the height of the ribs as formed in the first mold. If desired, a third mold that is further progressively shaped can be employed for further compression and densification of the panel.

The rigid mold pieces and the support plates can be made of various materials, including metallic or non-metallic materials. Suitable non-metallic materials can include hard plastic materials, hard rubber or rubber-like materials, fiber-matrix composite materials, ceramic materials, and others. The mold pieces can have water drain passages through them, or can be non-porous.

The rigid mold pieces are substantially more durable than compressible mold pieces, and compression-setting of the mold pieces is not an issue.

The mold pieces of the final mold preferably have relatively small draft angles (e.g., as low as 2 degrees, although they can be as high as 30 degrees). Small draft angles translate into ribs with side walls that are close to perpendicular to the flat face of the panel.

The panel can be at least partially dried while still in the second mold. In one embodiment, the second mold is non-metallic, and the panel is microwave dried while still in the second mold.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
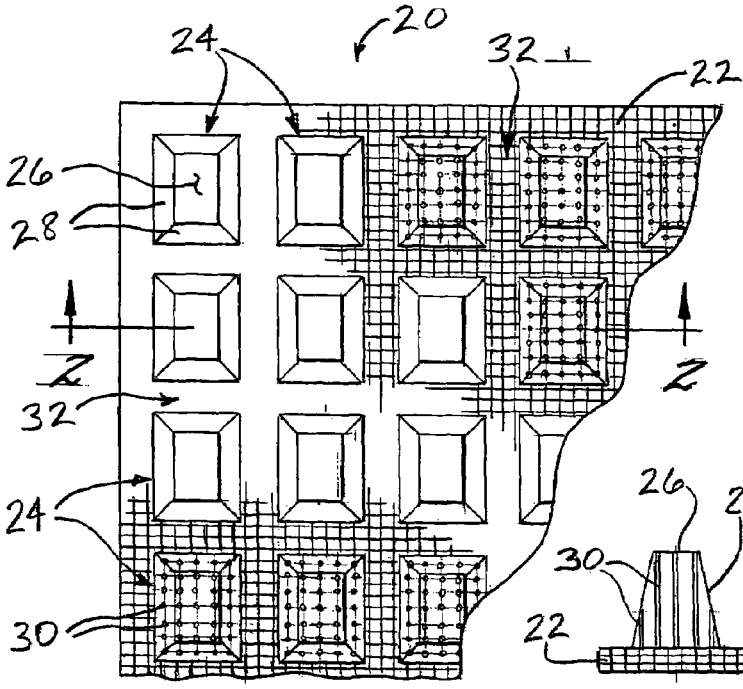
FIG. 1 is a top view of a first mold member in accordance with one embodiment of the invention.
Figure 2:
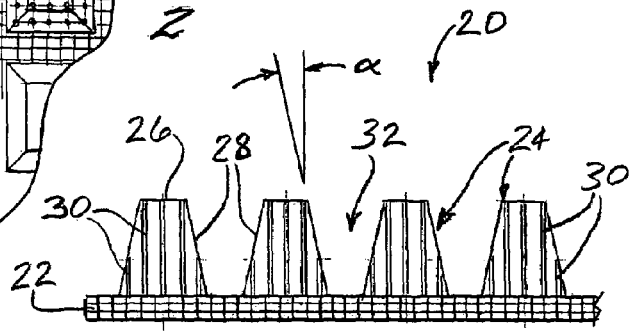
FIG. 2 is a cross-sectional view taken on line 2—2 in FIG. 1.
Figure 5:
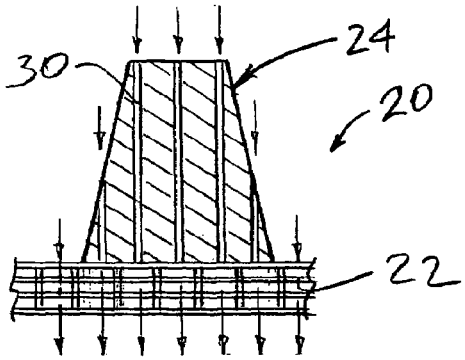
FIG. 5 is a cross-sectional view taken through a single mold piece of the first mold.

FIGS. 1, 2, and 5 depict a first mold member 20 of an apparatus for molding fibrous panels in accordance with one embodiment of the invention. The first mold member 20 comprises a support plate 22 that is porous so that water can drain through the plate. The plate 22 can be formed of various metallic or non-metallic materials, including but not limited to cast iron, steel, aluminum, and other metals, hard plastic materials, hard rubber or rubber-like materials, fiber-matrix composite materials, ceramic materials, and others. The porous support plate 22 can have various structures. For example, the plate can comprise a plate (which can be rigid) having holes extending through its thickness. Alternatively, the plate can comprise a screen or the like. As another example, the support plate can be comprised of more than one separate element each of which is porous or has drain holes through it; for instance, the support plate can comprise a lower plate (which can be rigid) having relatively large drain holes, and a screen having relatively smaller openings overlying the plate. An advantage of this arrangement is that the screen can have very small openings (which would be difficult to form through the plate) and can impart a substantially smooth finish to the flat side of a panel; additionally, the screen potentially can be made to be separable from the underlying plate to facilitate cleaning the screen as needed. The plate 22 alternatively can be formed of a porous metal, or a non-metal such as foamed plastic or ceramic.

The first mold member 20 also includes a plurality of rigid mold pieces 24 affixed to the upper surface of the plate 22. The mold pieces 24 are generally shaped as truncated 3D tapered structures (e.g., truncated conical or pyramidal structures), each having a generally flat upper surface 26 that is substantially parallel to the upper surface of the support plate 22, and one or more side surfaces 28 (i.e., a truncated cone would have one side surface formed as a surface of revolution, whereas a truncated pyramid would have a plurality of side surfaces angularly oriented with respect to one another as in FIG. 1) that extend from the upper surface 26 down to the top of the support plate 22. The side surfaces 28 preferably are substantially linear in vertical cross-section (as shown in FIGS. 2 and 5), although a small degree of concavity or convexity could be present. The side surfaces 28 form a nonzero draft angle $\alpha$ (FIG. 2) with respect to the vertical direction (i.e., the direction perpendicular to the support plate 22). The draft angle $\alpha$ preferably is sufficient in magnitude to allow the panel formed in the first mold member to be readily removed from the mold member; the large the draft angle, in general, the easier it is to remove the panel.

The mold pieces 24 can be formed of various metallic or non-metallic materials, including but not limited to cast iron, steel, aluminum, and other metals, hard plastic materials, hard rubber or rubber-like materials, fiber-matrix composite materials, ceramic materials, and others. The mold pieces, as noted, are rigid, i.e., substantially incompressible, so that under the levels of pressure exerted on them during a molding operation they do not undergo any substantial deformation. The mold pieces can be formed separately from and then affixed to the support plate 22 by various techniques, including but not limited to welding, affixing with adhesive, attaching with fasteners, or other techniques; alternatively, the mold pieces can be integrally formed with the support plate, such as by molding or casting, or by machining the plate and mold pieces from a single piece of material. The aforementioned techniques are given by way of example, and not by way of limitation; other techniques can be used. The mold pieces can include water drain passages 30 extending therethrough generally in the height direction of the mold pieces. The passages 30 communicate with drain openings in the support plate 22 so that water can drain through the passages 30 and then through the support plate, as further described below. Alternatively, the mold pieces can be non-porous so that all water draining occurs through the support plate.

The mold pieces 24 are arranged on the support plate 22 in an array, such as a column, row arrangement as shown in FIG. 1. The arrangement of mold pieces may also be specific to a need for a varying lattice or grid design. As a result of the arrangement of mold pieces, there are spaces or channels 32 between the mold pieces 24 that form an intersecting grid or lattice. These channels will form the ribs on a fibrous molded panel, as described below.

Figure 3:
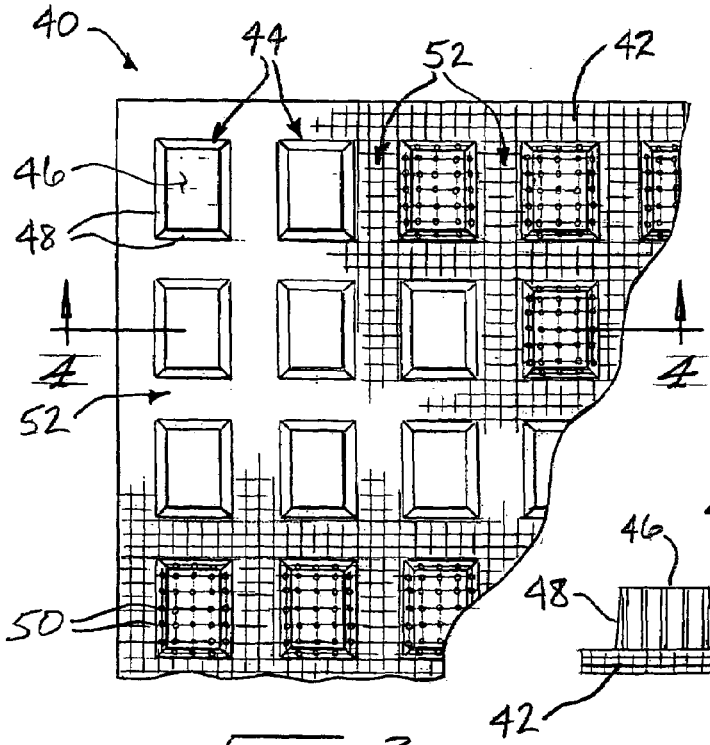
FIG. 3 is a top view of a second mold member.
Figure 4:
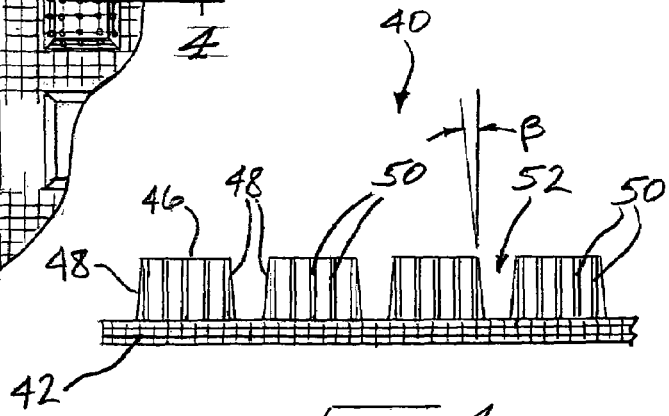
FIG. 4 is a cross-sectional view taken on line 4—4 in FIG. 3.

The apparatus for molding fibrous panels also includes at least one additional mold member, such as the mold member 40 shown in FIGS. 3 and 4. The mold member 40 is progressively formed with respect to the first mold member 20, as further described below. The mold member 40 includes a porous support plate 42, which can be constructed in generally the same manner as previously described for the support plate 22 of the first mold member. Attached to the support plate 42 are a plurality of mold pieces 44 of truncated conical or pyramidal configuration. The mold pieces 44 can be constructed in generally the same manner as previously described for the mold pieces of the first mold member. In particular, the mold pieces 44 are rigid, within the meaning previously set forth. The mold pieces have upper surfaces 46 that are generally planar and generally parallel to the support plate, and side surfaces 48 that extend from the upper surfaces 46 down to the support plate. The mold pieces 44 can include drain passages 50. The side surfaces 48 form a nonzero draft angle $\beta$ with respect to the vertical. Suitably, the draft angle $\beta$ can be from about 2° to about 30°, more preferably about 2° to about 20°. The side surfaces 48 can be linear in vertical cross-section (i.e., in a plane that is normal to the support plate 42).

The mold pieces 44 are arranged on the support plate 42 in an array, such as a column, row arrangement as shown in FIG. 3. The arrangement of mold pieces 44 generally would be substantially the same as or similar to the arrangement of mold pieces 24 in the previous mold, but the mold pieces 44 could be sized and/or spaced differently from the mold pieces 24. As a result of the arrangement of the mold pieces 44, there are spaces or channels 52 between the mold pieces 44 that form an intersecting grid or lattice. These channels will form the ribs on a fibrous molded panel, as described below. The mold pieces 44 are located, on center, substantially identically with the mold pieces 24 of the first mold member, so that the ribs on a panel formed in the first mold member will align with and fit into the channels 52 of the second mold member.

With respect to the progressive formation of the two mold members 20, 40, there are three significant geometrical properties of the second mold member 40, one or more of which differ from those of the first mold member 20: (1) the draft angle of the mold pieces; (2) the widths of the channels between the mold pieces; and (3) the height of the mold pieces. More particularly, the draft angle $\alpha$ of the first mold pieces 24 preferably is larger than the draft angle $\beta$ of the second mold pieces 44. Preferably, the first draft angle $\alpha$ is at least about 3° greater than the second draft angle $\beta$. This is another way of saying that the side surfaces of the mold pieces 44 are more upright (i.e., closer to perpendicular to the support plate) than those of the mold pieces 24, and hence the sides of the ribs formed in the second mold member 40 will be more upright than those of the ribs formed in the first mold member 20.

The widths of the channels 52 in the second mold member preferably are smaller than the widths of the channels 32 in the first mold member. Thus, the ribs formed in the second mold member will be thinner than those formed in the first mold member.

Finally, the height of the mold pieces 44 preferably is smaller than the height of the mold pieces 24. Therefore, the height of the ribs formed in the second mold member will be smaller than the height of the ribs formed in the first mold member.

The progressive configurations of the mold members 20, 40 are provided so that a panel formed and compacted in the first mold member can be further compacted and densified in the second mold member. This is illustrated in FIGS. 8A through 8E, which depict a series of process steps involved in molding a panel in accordance with the invention. In a first step, the first mold member 20 is positioned in a horizontal orientation and is filled with a fluid slurry or stock 60 containing fibers, and optionally containing other components such as fillers, additives, etc. The initial stock 60 generally will have a relatively low dry fiber content by weight, for example about 1% to about 10%. The mold member is filled to a depth exceeding the height of the mold pieces 24, as shown. To prevent the stock from flowing out the sides of the mold member, the mold member can be surrounded by a wall (not shown) that extends about the perimeter of the mold member.

Figure 8A:
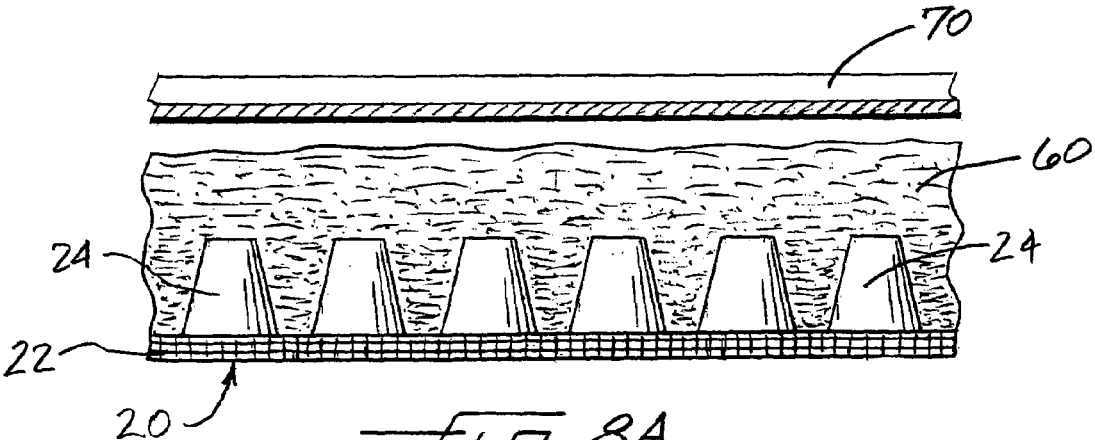
FIG. 8A illustrates a first step in a process for making a fibrous panel in accordance with one embodiment of the invention, wherein an aqueous fiber stock is deposited into a first mold member.
Figure 8B:
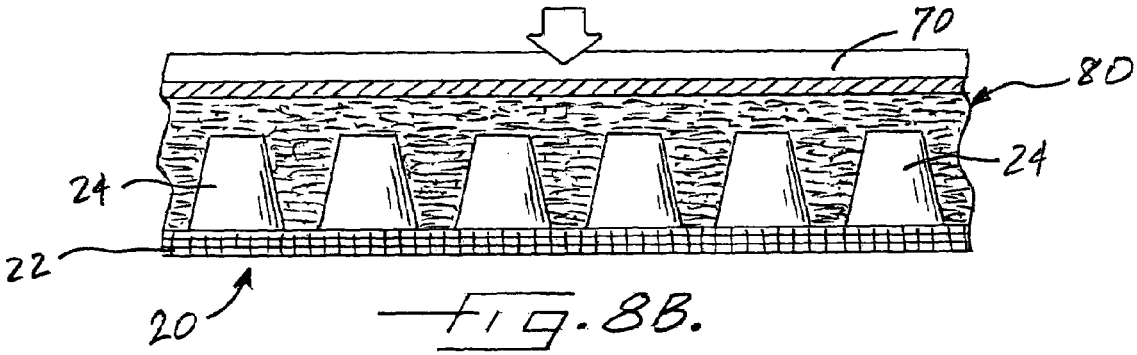
FIG. 8B shows the stock being compressed in the first mold member to form a wet panel.

Next, as shown in FIG. 8B, a mold plate 70 having a substantially planar lower surface is pressed downward onto the stock and is urged toward the support plate 22 of the mold member. As a result, water from the stock 60 is forced through the porous support plate 22; the openings in the plate are sized to substantially prevent fibers in the stock from passing through. In the case where the mold pieces 24 also have water drain passages, water also is forced through those passages. Additionally, the mold plate 70 can also include water drain passages, if desired. Accordingly, the stock 60 is dewatered to some extent. The pressure exerted by the mold plate 70 that is suitable for achieving a desired degree of dewatering depends on a number of factors. The pressure exerted by the mold plate 70 can be about 100 to 150 psi.

Figure 8C:
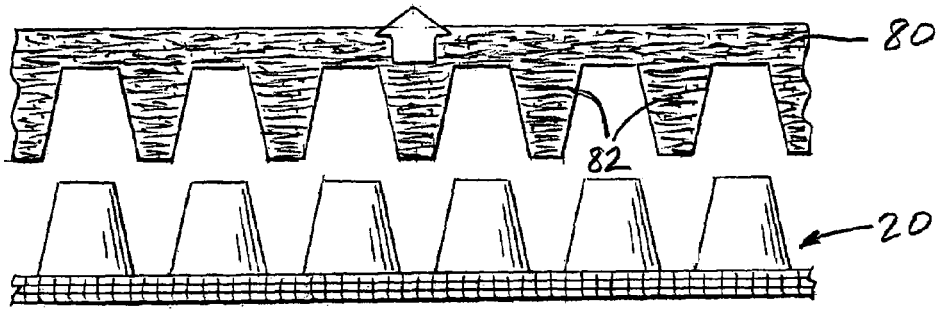
FIG. 8C shows the wet panel being removed from the first mold member.

FIG. 8C illustrates that the next step in the process is to remove the panel 80 from the first mold member 20. The relatively large draft angle $\alpha$ of the mold pieces 24 facilitates removal of the panel, which at this point is semi-dry. It will be noted that the sides of the ribs 82 on the panel are inclined to a substantial extent relative to the planar face of the panel, which reflects the relatively large draft angle $\alpha$.

Figure 8D:
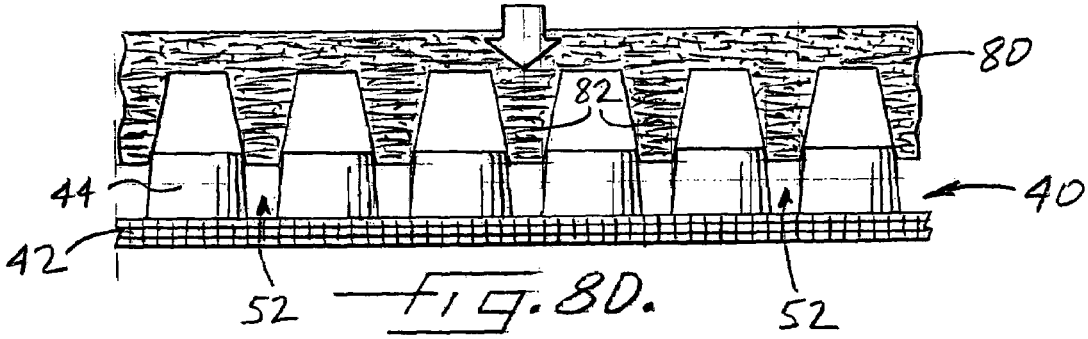
FIG. 8D depicts the wet panel being inserted into a second mold member.

The semi-dry panel is then placed into the second mold member 40 as depicted in FIG. 8D. The ribs 82 on the panel align with the channels 52 in the mold member. However, because the channels 52 are narrower and shallower than the ribs 82 (by virtue of the greater width and smaller height of the mold members 44 relative to the mold members 24), it is evident that further densification of the panel will occur upon pressing.

Figure 8E:
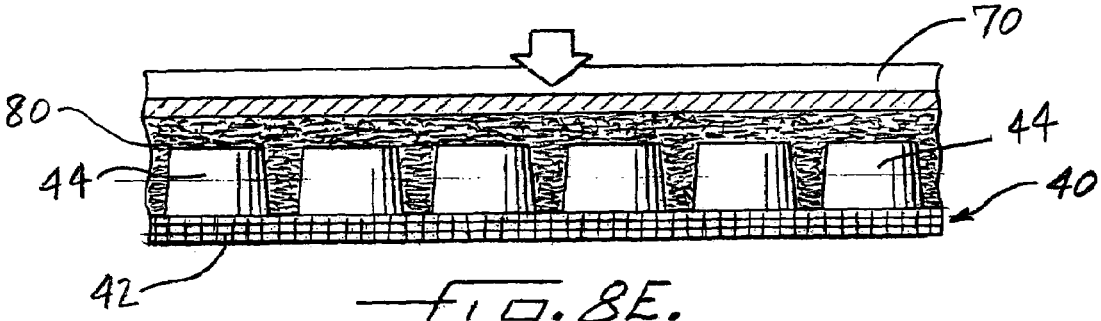
FIG. 8E illustrates the panel being compressed in the second mold member.

FIG. 8E shows the panel 80 being pressed by the mold plate 70. The panel is compressed into a total volume that is smaller than the starting volume of the panel, because the channels are narrower and shallower than the ribs. Thus, the panel is further densified as additional water is expressed through the porous support plate 42 (and, if present, the drain passages in the mold pieces 44). It is important to note that because of the progressive formation of the mold members 20, 40, the panel's ribs 82 are compressed and densified not only in the vertical direction along which the mold plate 70 is urged, but also in the lateral direction (left-to-right in FIG. 8E). This lends substantial strength and stiffness to a finished panel because the panel has substantially uniform density in all directions.

The second pressing in the mold 40 suitably can be carried out at a pressure of about 50 to 200 psi. The panel at this point typically will have a density of about 10 to 20 $lb/ft^3$.

Figure 8F:
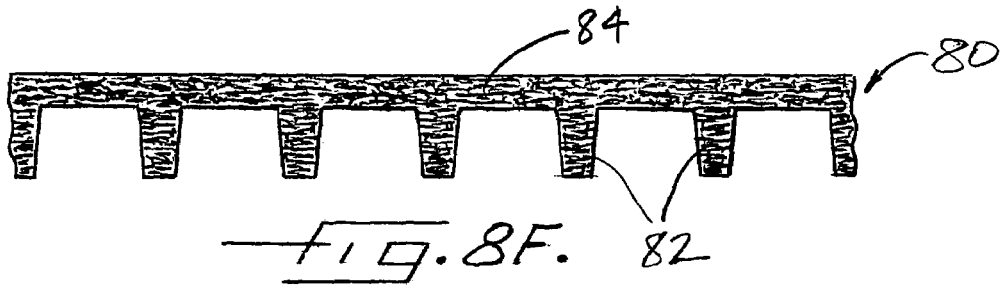
FIG. 8F shows the panel after removal from the second mold member.

To create the finished panel, the panel must be dried to evaporate substantially all of the remaining water. The drying suitably is performed by thermal drying techniques. For instance, the panel 80 can be removed from the mold member 40 (see FIG. 8F) and placed into a drying device such as an oven or microwave dryer for a sufficient period of time for the panel to reach the desired dryness. Alternatively, the panel can be dried while still in the mold member 40. In the case of microwave drying, this requires that the mold member 40 be constructed of non-metallic materials. For instance, the mold member can be constructed of ceramic.

Figure 9:
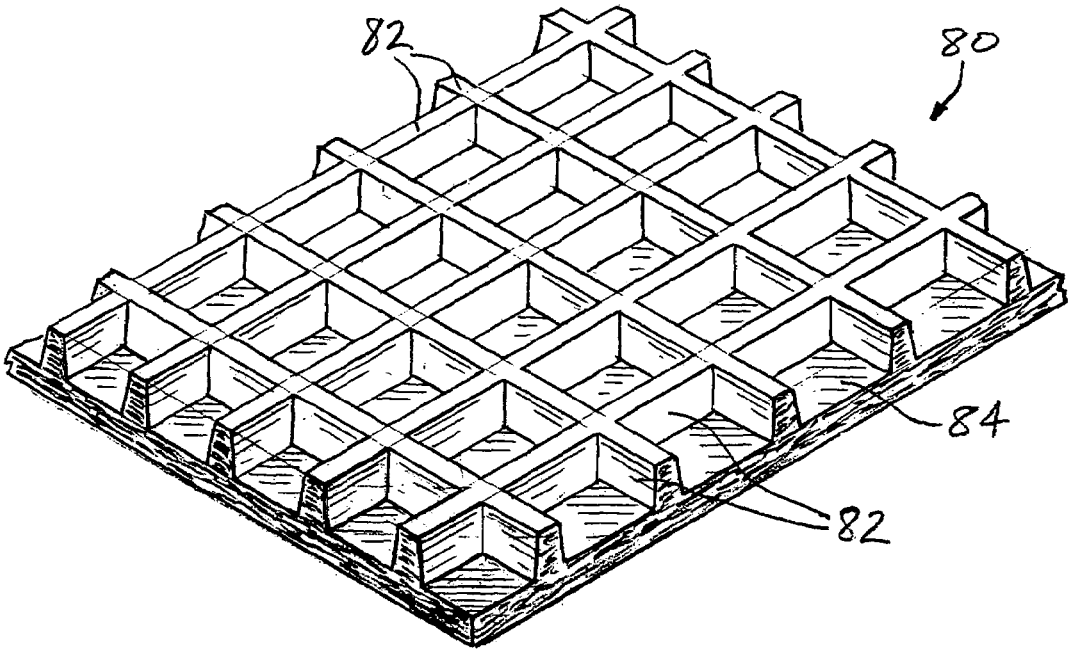
FIG. 9 is a perspective view of the finished panel.

FIG. 9 shows a finished panel 80 having ribs 82 that are substantially parallel-sided (i.e., having the opposite side surfaces of the ribs parallel to each other, and thus perpendicular to the planar face 84 of the panel).

Figure 6:
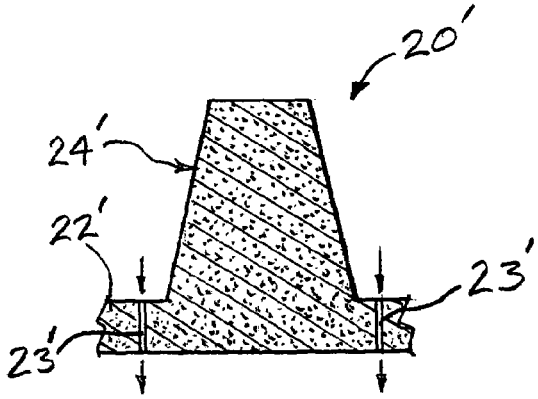
FIG. 6 is a view similar to FIG. 5, showing an alternative embodiment of a mold member in accordance with the invention.

A ceramic first mold member 20' is shown in FIG. 6. It will be noted that this mold member does not include water drain passages through the mold pieces 24'. The mold pieces also are formed integrally with the porous support plate 22'. The support plate 22' has water drain passages 23' extending therethrough.

Figure 7:
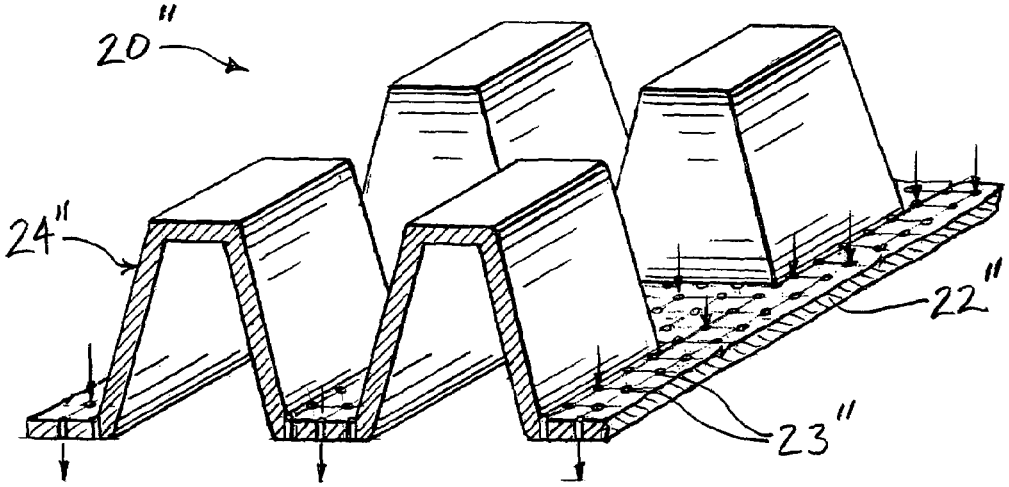
FIG. 7 is a perspective view of yet another embodiment of a mold member in accordance with the invention.

FIG. 7 shows yet another possible construction for a first mold member 20". The mold member is an integral one-piece metal construction (which might be formed, for example, by casting or machining). The mold pieces 24" are hollow rather than solid, and do not include drain passages. The support plate 22" has water drain passages 23" therethrough.

Various other materials and construction methods can be used for making the mold members of the apparatus, as previously noted. The important factor is that the mold members be progressively configured as described. By progressively forming the mold members, the mold members can be rigid, as opposed to the requirement of using elastomeric mold pieces as in the prior art. By progressively reducing the draft angle from one mold member to the next, the ribs of a panel are progressively formed to be closer and closer to parallel-sided. Additionally, the reduction in height and increase in width of the mold pieces from one mold member to the next result in progressive densification of the ribs in the vertical or height direction as well as in the lateral or width direction. Although only two mold members have been illustrated and described, the invention can employ more than two progressively formed mold members if desired.

The ribs 82 shown in FIG. 9 form a simple orthogonal grid, but it will be recognized that various other rib configurations can be used in accordance with the invention by suitably configuring the mold pieces of the mold members. Among the advantages of the invention is that because the mold members are rigid and thus do not deform appreciably during the pressing, the configuration of the ribs of the panel can be precisely controlled by precisely controlling the configuration of the last mold member that produces that final panel form. In contrast, with prior panel-forming methods and apparatus employing rubber mold pieces that substantially deform during pressing, the panel configuration is dependent on the deformed shape of the mold pieces, which may be difficult to accurately predict or control. Additionally, with deformable mold pieces, it is difficult to provide mold pieces of complex shapes, but the rigid molds in accordance with the invention can be shaped in virtually any desired configurations, as long as the mold pieces have a sufficient draft angle to allow the panel to be removed from the molds.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A process for forming a three-dimensional fibrous panel, comprising the steps of:

providing first and second mold members each comprising a porous support plate and a plurality of rigid mold pieces attached to the support plate, the mold pieces comprising truncated 3D tapered structures and being spaced apart on the support plate to form channels between the mold pieces, the mold pieces of the second mold member having a larger cross-section and lesser taper than the mold pieces of the first mold member;

depositing a fiber stock into the first mold member to cover the mold pieces, and pressing the fiber stock into the first mold member to dewater the stock through the porous support plate and densify the stock so as to form a panel having ribs as defined by the channels in the first mold member;

removing the panel from the first mold member and inserting the panel into the second mold member; and pressing the panel into the second mold member to further dewater and densify the panel.

2. An apparatus for molding fibrous panels from a fiber stock, comprising:

first and second mold members each comprising a porous support plate and a plurality of rigid mold pieces attached to the support plate, the mold pieces comprising truncated 3D tapered structures and being spaced apart on the support plate to form channels between the mold pieces, the mold pieces of the second mold member having a larger cross-section and lesser taper than the mold pieces of the first mold member; and a flat mold plate for pressing a fiber stock into each of the first and second mold members.

3. The apparatus of claim 2, wherein the support plates comprise screens.

4. The apparatus of claim 2, wherein the mold pieces are metal.

5. The apparatus of claim 2, wherein the first and second mold members are non-metallic.

6. The apparatus of claim 2, wherein the first and second mold members are ceramic.

7. The apparatus of claim 2, wherein the first and second mold members are resinous.

8. The apparatus of claim 2, wherein at least one of the first and second mold pieces have water drain passages therethrough.

9. The apparatus of claim 2, wherein the mold pieces of the second mold member define a draft angle from about 2 degrees to about 30 degrees.

10. The apparatus of claim 2, wherein the mold pieces of the first mold member define a draft angle at least about 3 degrees greater than that defined by the mold pieces of the second mold member.

11. The apparatus of claim 2, wherein the mold plate has water drain passages therethrough.

12. The apparatus of claim 2, wherein the mold pieces of the second mold member have a smaller height than the mold pieces of the first mold member.

13. A process for forming a three-dimensional fibrous panel, comprising the steps of:

depositing a fiber stock into a first mold member, the first mold member comprising a flat, first support plate having a top surface and a bottom surface and water drain passages extending therebetween, and a plurality of rigid first mold pieces affixed to the top surface of the first support plate, the first mold pieces comprising truncated 3D tapered structures having generally flat upper surfaces and having side surfaces extending from the upper surfaces down to the first support plate, the first mold pieces being spaced apart on the first support plate so as to define channels between the first mold pieces, wherein said side surfaces of the first mold pieces form a first nonzero draft angle relative to vertical, the fiber stock filling the first mold member to a depth greater than a height of the first mold pieces so that the stock covers the upper surfaces of the first mold pieces;

disposing a flat mold plate atop the stock in the first mold member, and urging the mold plate toward the first mold member to compress the stock into the first mold member and cause water to be drained from the stock through the water drain passages so as to form a panel having a flat face and intersecting ribs projecting therefrom as defined by the channels in the first mold member;

removing the panel from the first mold member;

inserting the panel into a second mold member having a second support plate with water drain passages therethrough and rigid second mold pieces affixed to the second support plate and arranged to form channels that receive the ribs on the panel, the second mold pieces having generally flat upper surfaces and having side surfaces extending from the upper surfaces down to the second support plate, wherein said side surfaces form a second draft angle relative to vertical, the second mold pieces being shorter in height than the first mold pieces, the second draft angle of the second mold pieces being smaller than the first draft angle of the first mold pieces, and the channels of the second mold member being narrower than the channels of the first mold member;

disposing the mold plate atop the panel and urging the mold plate toward the second mold member to compress the panel into the second mold member and cause further water to be drained from the panel through the water drain passages, the panel being compressed and densified in a thickness direction of the panel and the ribs also being densified in a lateral direction by virtue of the channels being narrower than those of the first mold member; and removing the panel from the second mold member.

14. The process of claim 13, further comprising the step of thermally drying the panel while the panel is disposed in the second mold member.

15. The process of claim 14, wherein the second mold member is non-metallic, and the step of thermally drying the panel comprises microwave drying the panel while disposed in the second mold member.

16. The process of claim 13, further comprising the step of thermally drying the panel after removal from the second mold member.

17. A fibrous panel molded from a fibrous stock by a method comprising the steps of:

providing first and second mold members each comprising a porous support plate and a plurality of rigid mold pieces attached to the support plate, the mold pieces comprising truncated 3D tapered structures and being spaced apart on the support plate to form channels between the mold pieces, the mold pieces of the second mold member having a larger cross-section and lesser taper than the mold pieces of the first mold member;

depositing a fiber stock into the first mold member to cover the mold pieces, and pressing the fiber stock into the first mold member to dewater the stock through the porous support plate and densify the stock so as to form a panel having ribs as defined by the channels in the first mold member;

removing the panel from the first mold member and inserting the panel into the second mold member; and pressing the panel into the second mold member to further dewater and densify the panel;

the panel thus comprising a face from one side of which project a plurality of intersecting ribs molded integrally with the face, the ribs having a configuration precisely defined by the cross-section, taper, and spacing of the mold pieces on the second mold member.

18. The fibrous panel of claim 17, wherein the mold pieces of the second mold member have side faces that are linear in a plane normal to the support plate, such that the ribs of the panel have side faces that are linear in a plane normal to the face of the panel.

* * * * *